US009340325B2

(12) United States Patent
Pontoriero

(10) Patent No.: US 9,340,325 B2
(45) Date of Patent: May 17, 2016

(54) APPARATUS TO FACILITATE SEPARATION OF LAYERS OF MATERIAL

(71) Applicant: Josephine Pontoriero, Union, NJ (US)

(72) Inventor: Josephine Pontoriero, Union, NJ (US)

( * ) Notice: Subject to any disclaimer, the term of this patent is extended or adjusted under 35 U.S.C. 154(b) by 0 days.

(21) Appl. No.: 14/597,367

(22) Filed: Jan. 15, 2015

(65) Prior Publication Data

US 2015/0197375 A1 Jul. 16, 2015

Related U.S. Application Data

(63) Continuation of application No. 61/928,079, filed on Jan. 16, 2014.

(51) Int. Cl.

| | |
|---|---|
| ***G06K 19/06*** | (2006.01) |
| ***B65D 33/00*** | (2006.01) |
| ***B65B 43/32*** | (2006.01) |

(52) U.S. Cl.

CPC ..... *B65D 33/007* (2013.01); *B65B 43/32* (2013.01); *Y10T 428/24322* (2015.01); *Y10T 428/24488* (2015.01); *Y10T 428/26* (2015.01)

(58) Field of Classification Search

USPC ..... 235/494, 380, 487, 375

See application file for complete search history.

(56) References Cited

U.S. PATENT DOCUMENTS

| | | | | |
|---|---|---|---|---|
| 2,505,289 | A | 4/1950 | Haslett | |
| 2,851,838 | A | 9/1958 | McIntyre et al. | |
| 2,932,142 | A | 4/1960 | Sindzinski | |
| 3,972,157 | A | 8/1976 | Meyers | |
| 4,601,690 | A | 7/1986 | Jacobson | |
| 4,698,051 | A | 10/1987 | Jacobson | |
| 5,213,145 | A | 5/1993 | Huang et al. | |
| 5,794,768 | A * | 8/1998 | Skeffington | A45C 13/023 206/37.1 |
| 5,914,170 | A * | 6/1999 | Rabe et al. | 428/119 |
| 6,512,718 | B2 * | 1/2003 | Lee | G11C 11/418 365/154 |
| 8,413,357 | B1 * | 4/2013 | Hagen et al. | 40/300 |
| 2006/0202041 | A1 * | 9/2006 | Hishizawa et al. | 235/492 |
| 2009/0146818 | A1 * | 6/2009 | Strauser | G08B 13/242 340/572.1 |
| 2009/0262514 | A1 * | 10/2009 | Sturley | E01C 5/22 362/34 |
| 2010/0276920 | A1 * | 11/2010 | Woodman | B42D 25/00 283/75 |
| 2010/0294835 | A1 * | 11/2010 | Bam | G06Q 20/28 235/382 |
| 2013/0223766 | A1 | 8/2013 | Gebhart | |
| 2014/0282067 | A1 * | 9/2014 | Cheng | 715/748 |

FOREIGN PATENT DOCUMENTS

| | | |
|---|---|---|
| DE | 20003608 | 8/2000 |
| FR | 2893590 | 5/2007 |
| GB | 2271756 | 4/1994 |
| GB | 2283958 | 5/1995 |
| GB | 2308087 | 6/1997 |
| JP | 2007030982 | 2/2007 |
| WO | 0076871 | 12/2000 |

(Continued)

*Primary Examiner* — Edwyn Labaze

(74) *Attorney, Agent, or Firm* — Gearhart Law, LLC

(57) ABSTRACT

An apparatus may have an anti-slip coating covering all or some of the apparatus. The anti-slip coating may also be on an upper surface, lower surface, or both. The apparatus has an aperture to provide for attachment to a key chain ring or other similar objects. The apparatus can come in a number of shapes and sizes and can be designed with ergonomics in mind. The apparatus is generally useful for separating thin plastic layers such as those one encounters with plastic bags. The apparatus is used to provide a frictionable surface to efficiently separate the layers thereby facilitating opening of the plastic bag or similarly thin layers of material.

8 Claims, 2 Drawing Sheets

(56) References Cited

FOREIGN PATENT DOCUMENTS

| | | |
|---|---|---|
| WO | 0123263 | 4/2001 |
| WO | 0125091 | 4/2001 |
| WO | 2009108078 | 9/2009 |
| WO | 2012078106 | 6/2012 |

* cited by examiner

APPARATUS TO FACILITATE SEPARATION OF LAYERS OF MATERIAL

CLAIM OF PRIORITY

This claims priority to U.S. Application 61/928,079 filed on Jan. 16, 2014, the contents of which are herein fully incorporated by reference in its entirety.

FIELD OF THE EMBODIMENTS

The field of the invention and its embodiments relate to an apparatus for use in conjunction with a key ring or other secondary item. In particular, the embodiments describe an apparatus that has an anti-slip layer disposed on a surface thereof that can be used to open stubborn plastic bags and other similarly situated layers of material.

BACKGROUND OF THE EMBODIMENTS

Plastic bags are typically used by consumers to hold or haul goods purchased at a particular retailer or discard waste. These bags are often reused for storage or waste, but other times they are simply thrown away. Disposable plastic bags have been used throughout this country and others for decades, but their use rose to prominence, in the 1980s, in supermarkets and later became a staple in most shopping centers.

As the usage of plastic bags increased, it became advantageous for the manufacturers of these bags to create a cheaper bag. This led to plastic bags being produced that were thinner and thinner. These bags are often tightly rolled as to minimize the space they take up in retail outlets.

Additionally, the manufacturing of these bags often result in small static charges being applied to the bags. The end result is extremely thin layers of plastic tightly pressed together and exhibiting static charges. This often provides difficulty for the consumer in opening such bags in a proper and efficient manner. In a time where efficiency and technological advances are prominent, these bags provide neither. Thus, there is a great need for a device that allows one to readily and efficiently assist an individual in opening a plastic bag without the use of adhesives.

Further, such an apparatus may be helpful in separating other items such as waste bags for animals. Often when walking a dog, an owner will carry a plastic bag for removal of pet waste from a public area or property. It can be challenging to try to open the bag in a timely fashion to prevent the dog or other pet or person from stepping in the waste before removal. Dog owners may also have a pet waste disposable bag dispenser attached to the dog leash. The roll of plastic bags in the dispenser are tightly rolled to minimize the space they take up in the dispenser which make them very thin and very difficult to open.

Further, such an apparatus may be beneficial in reducing and preventing the spread of germs. Typically supermarket customers lick their fingers when plastic bags in departments such as the produce and bakery department are difficult to open. Additionally, employees of a retailer, such as grocery store employees, also lick their fingers at check out when plastic bags are difficult to separate. Human skin, including our fingers can carry many germs including those that cause colds and the flu.

Additionally, many people have similar issues with paper products. In many people grip and dexterity decreases as one ages. Further, pages of books and magazines and the like can become stuck together and are difficult to turn. Other tasks involving many layers of paper such as handing out paper to school children or counting money can lead to painful paper cuts and prolonged paper handling times due to the paper being difficult to separate.

Thus, there is a need for an invention that can effectively assist a user in separating thin layers of material in an efficient and expeditious manner. This also enables those with decreased dexterity and grip strength a practical solution to facilitate usage of all items regardless of age or ability. The present invention and its embodiments meets and exceeds these objectives.

Review of Related Technology

U.S. Pat. No. 4,601,690 pertains to a plastic bag opening device that has a flexible U-shaped member which can be slipped over the slit edge of a plastic bag. Multilayer adhesive strips are affixed to the inside of the ends of the U-shaped member so as to contact the sides of the plastic bag when the U-shaped member is forced to a closed position. As the U-shaped member is flexed to an open position the sides of the bag adhere to the adhesive substance on the end of each exposed layer so that the sides of the bag are pulled apart from each other.

International Application WO2012/078106 pertains to a device for facilitating the separation of thin objects which adhere to each other, such as for example bags of plastic or similar material, and which consists of a stationary body. A number of grooves extending in defined directions, which are embedded in said body, are arranged to exhibit a sticky surface or another material adhering to an intended applicable object, and which grooves converge in a common center for picking up one separable side of a bag or another thin object by means of a grip obtained between the thumb and further finger/fingers of the person in question.

International Application WO2009/108078 pertains to a plastic bag with friction fields for opening, which has friction fields applied, on the outer sides of bag walls, close to the bag end which is opened, friction fields having the coefficient of friction with human fingers greater than the coefficient of friction between the bag walls and the fingers. If these two facing friction fields are touched by fingers (e.g. one field by the thumb and the facing one by the index finger) and the fingers perform a sliding movement to open the bag, such construction would render the opening of the bag much easier.

GB2271756 pertains to a plastic bag that has an enhanced-friction patch provided at or near the top of its side wall, formed e.g. by knurling, stippling, or perforation. The patch facilitates manual gripping of the side walls, making it easier to separate them when opening the bag. The advantage is most pronounced with mass-produced plastic bags of very thin material (e.g. less than 50 μm).

Various devices and methodologies are known in the art. However, their structure and means of operation are substantially different from the present disclosure. Known devices employ adhesives and are typically bulky and not readily portable or reusable. The other inventions also fail to solve all the problems taught by the present disclosure. By providing a small tag with an anti-slip surface, the present invention provides a quick, portable, inexpensive, and reusable way to separate layers of thin materials. At least one embodiment of this invention is presented in the drawings below and will be described in more detail herein.

SUMMARY OF THE EMBODIMENTS

An apparatus is described and taught having a tag body with at least an upper surface and a lower surface, wherein at least one of the upper or lower surfaces is partially or completely coated in an anti-slip substance.

In another embodiment, there is an apparatus having a tag body with an upper surface and a lower surface with an aperture extending there through; and a resin disposed on at least the upper surface or the lower surface of the apparatus, wherein the resin either partially covers or fully covers the respective surface or surfaces, wherein the resin forms a rounded, sloping edge where it meets the edge of the apparatus.

Generally, the apparatus can have a number of shapes and sizes depending on user preferences including ergonomics. The apparatus has a tag body that may comprise a number of materials including but not limited to metal, plastic, resin, composite, glass, stone, fiberboard, paper, or the like or any combination thereof. Further, the tag body may have an aperture that provides for the attachment of a charm, bracelet, necklace, key chain ring or the like. On a surface of the tag body, an anti-slip substance is disposed thereon. The anti-slip substance may be on an upper surface, lower surface, or both. Additionally, the anti-slip substance may partially cover or completely cover the respective surface of the tag body. Along the edge or perimeter of the tag body, the anti-slip substance may be beveled or rounded to provide a smooth edge that helps to prevent user injury and damage to items used in conjunction with or kept in proximity of the apparatus.

The anti-slip substance is preferably an anti-slip, water resistant or water proof resin; however, other materials exhibiting similar properties may be used solely or in conjunction with one another. The anti-slip substance provides for a frictionable surface rather than employing an adhesive surface. This gives the apparatus the ability to work under less than ideal conditions while not sticking to other undesired objects. The anti-slip substance should have a coefficient of friction with plastic of at least 0.2 and more preferably about 0.5. In some embodiments, the coefficient of friction is about 1 to about 2. The preferable usage for the apparatus is to separate thin layers of material, namely plastic bags. In turn, the apparatus may be used to aid in separation of a number of different types of layered or unlayered material.

In general, the present invention succeeds in conferring the following, and others not mentioned, benefits and objectives.

It is an object of the present invention to provide an apparatus that is readily portable and transportable.

It is an object of the present invention to provide an apparatus that is durable and inexpensive.

It is an object of the present invention to provide an apparatus with an anti-slip surface that aids an individual in separating layers of an article of manufacture.

It is an object of the present invention to provide an apparatus that is water proof or water resistant.

It is an object of the present invention to provide an apparatus that can be used in conjunction with a secondary item such as a key chain ring, bracelet, necklace, or the like.

It is an object of the present invention to provide an apparatus that can be given to employees or customers of a retailer such as a grocery store for use with thin plastic bags.

It is an object of the present invention to provide an apparatus that is readily reusable.

It is an object of the present invention to provide an apparatus that generates a high coefficient of friction with most items, preferably plastic based items.

It is an object of the present invention to provide an apparatus that is lightweight and user friendly.

DETAILED DESCRIPTION OF THE PREFERRED EMBODIMENTS

Figure 1A:
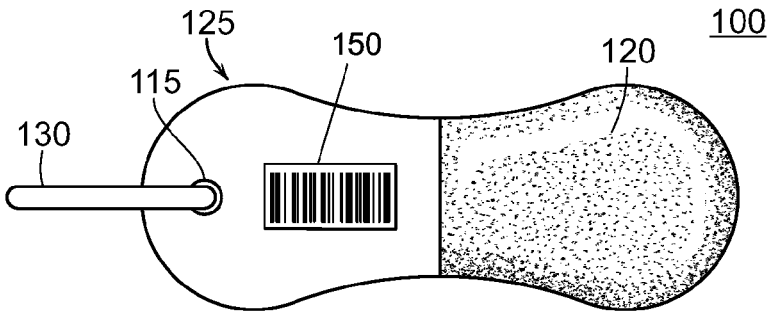
FIG. 1A is a top view of a first embodiment of the present invention.

The preferred embodiments of the present invention will now be described with reference to the drawings. Identical elements in the various figures are identified, as far as possible, with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Figure 1B:
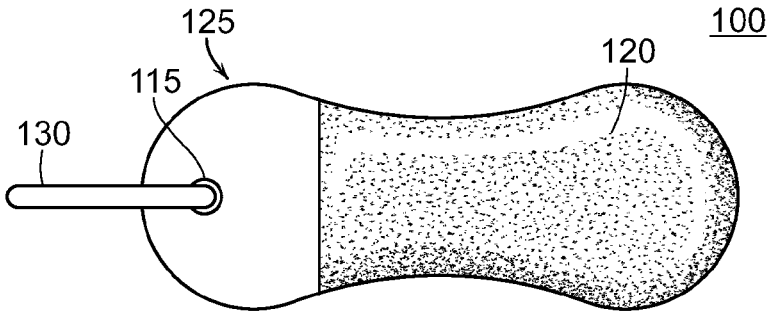
FIG. 1B is a top view of a second embodiment of the present invention.

Referring to FIGS. 1A and 1B, there is an apparatus 100 having a tag body 125. The tag body 125 can come in a number of shapes and bear a number of designs. Preferably the size of the tag body 125 should be of a size to provide a sufficient workable surface area while not being overly cumbersome or interfere with daily affairs.

Generally, the tag body 125 should be resilient enough to be handled on a routine basis and can be stored in pockets alongside keys, electronics, and the like. Thus, the tag body 125 may be a metal, plastic, resin, composite, glass, stone, or the like or any combination thereof. In some embodiments the tag body comprises cardboard, paperboard, fiberboard, vinyl, foam board, and the like or any combination thereof. In some embodiments the tag body 125 is a plastic such as polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or any combination thereof.

Alternatively, the tag body 125 may be a composite material, for example, Formica. Such materials can provide the needed strength and wear-resistant properties required whilst providing flexibility thereby helping to prevent the tag body 125 from bending and subsequently cracking or breaking.

The tag body 125 may also have an aperture 115. Preferably, the aperture 115 is located towards a terminal edge of the tag body 125 thereby providing an adequate mechanism for attachment and providing a large, uninterrupted workable surface area. The aperture 115 may be designed such that the apparatus 100 can be attached to an object or secondary object such as a key chain ring 130. Disposed on at least one of the upper surface 105 and lower surface 110 (see FIGS. 2A and 2B) is anti-slip layer 120. The anti-slip layer 120 may partially or fully cover the respective surface of the tag body 125.

As shown in FIG. 1A, there may be a scannable barcode 150 disposed on a surface of the apparatus 100. Thus, the present invention may embody a supermarket rewards card and be used in the same fashion, but including the dual function attributed to the anti-slip layer 120. When one signs up for a rewards program through such a store they are given a similar type item with a logo and/or store name with a scannable bar code on the reverse. Thus, the apparatus 100 may function in the same capacity and the anti-slip layer 120 may either leave such a scannable barcode 150 uncovered or not impede the reader by covering the bar code 150 (i.e. opaque anti-slip layer 120). The envisioned uses, coloring, size, and shape of the apparatus 100 are virtually limitless and only limited by the particular intended usage.

Figure 2A:
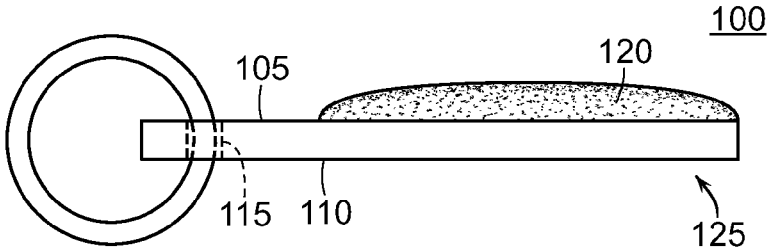
FIG. 2A is a side view of first embodiment of the present invention.
Figure 2B:
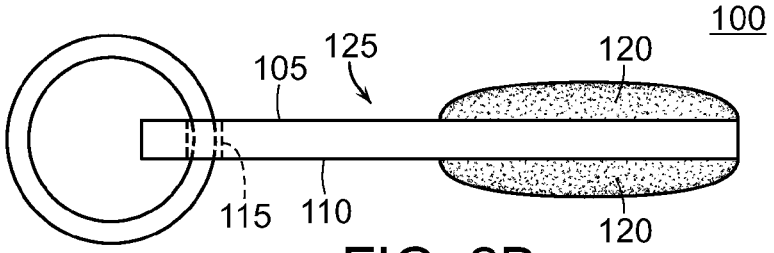
FIG. 2B is a side view of an alternate embodiment of the present invention.

In FIGS. 2A and 2B, there is the apparatus 100 as shown from the side. In FIG. 2A, the anti-slip layer 120 is disposed along the upper surface 105 only. In FIG. 2B, the anti-slip layer 120 is disposed along both the upper surface 105 and the lower surface 110. Additionally differing amounts and coverage of the anti-slip layer 120 is shown between FIGS. 2A and 2B. The coverage and thickness of the anti-slip layer 120 can vary with the particular usage or user preferences. In both instances, the rounded, sloping shape of the disposed anti-slip layer 120 layer is shown. However, this is not the only configuration and it may be desirable in some circumstances to have a differently shaped anti-slip layer 120.

Figure 3:
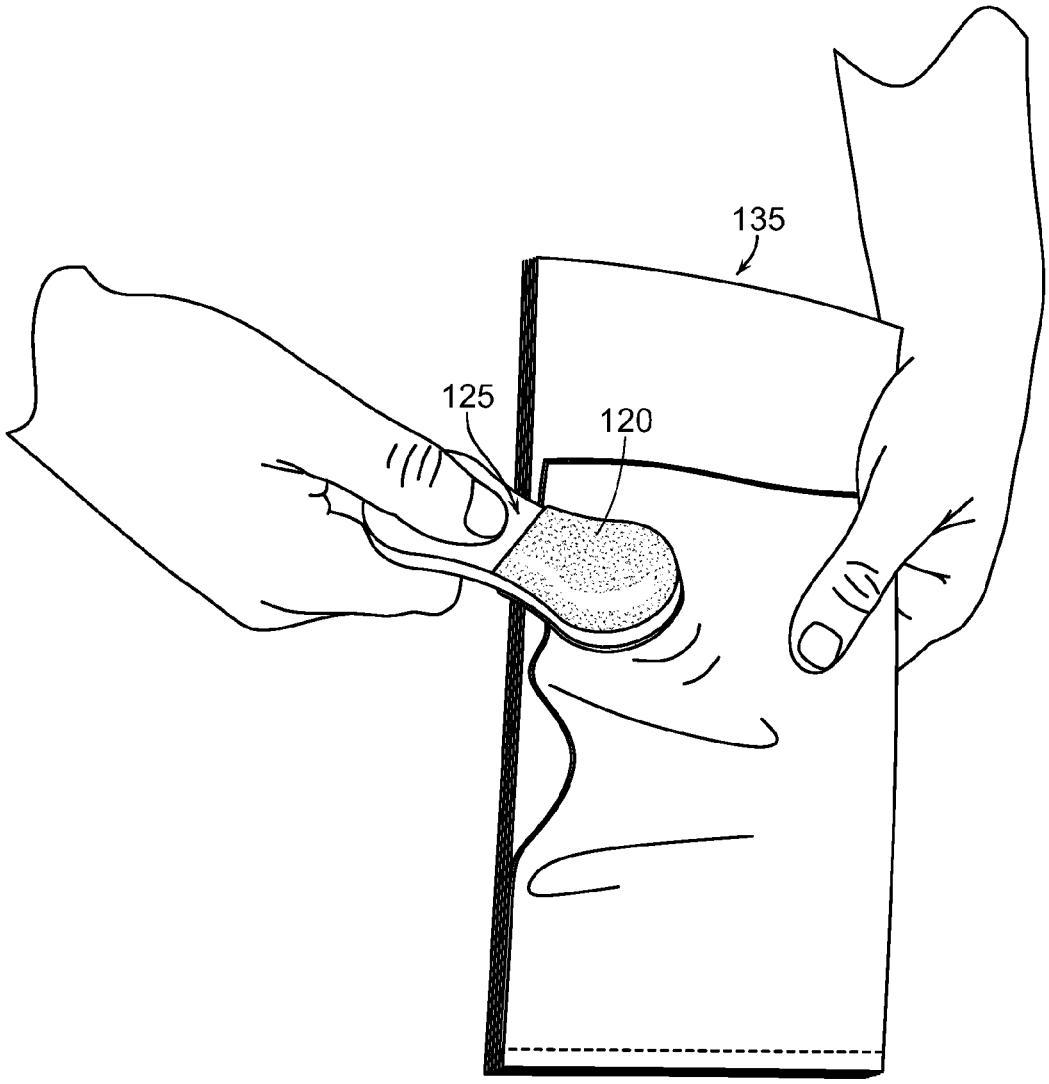
FIG. 3 is a representation demonstrating the present invention used as intended in at least one scenario.

In FIG. 3, the apparatus 100 is shown being used in one manner as intended. Often when a user's fingers are dry, there is not adequate friction available between thin plastics and human skin. The apparatus 100 repels most liquids and generates a high coefficient of friction under less than ideal conditions. A user would hold the apparatus 100 by a portion of the tag body 125. The anti-slip layer 120 is directed towards the intended target, in this case, a thin plastic bag 135 which may be a grocery bag, produce bag, trash bag, and the like or combinations thereof.

Using a shearing motion with the apparatus 100 and the thin plastic bag 135, the anti-slip layer 120 possesses a sufficient coefficient of friction to enable such layers to be easily separated. This may aid in separating layers of individual thin plastic bags 135 from one another or aid in separating layers of the same bag thereby aiding in opening of the bag. A user simply touches the anti-slip layer 120 to the thin plastic bag 135. Once contact between the two has been made, a user simply uses a desired motion thus creating friction and completing the task at hand. The items and uses for the apparatus 100 are not limited to opening or separating thin plastic layers and may have a practical functionality anywhere a frictionable surface is required. Due to the high friction properties of the apparatus 100, the apparatus 100 is functional when a user's hands are covered by thick gloves or other non-friction producing items or substances.

Generally, the apparatus 100 described in FIGS. 1-3 can take a number of forms and shapes. In some instances, the shape may be influenced by its intended purpose. For example, many dog owners take their dogs for walks through various neighborhoods. Often these individuals carry small plastic baggies for cleaning up waste left behind on the road or the property of another. Thus, the apparatus 100 may be shaped like a dog bone or dog paw or the like and be intended to be used by dog owners in aiding the opening of such waste bags.

In other instances, the apparatus 100 can be used as a book mark and assist one in turning the pages of the book. The apparatus 100 may generally provide any type of assistance with separating or moving sheets of paper including in counting money and the aforementioned turning of pages of a book, magazine, journal, and the like.

The apparatus 100 may also bear a brand, logo, slogan, or the like. For example, shopping centers may include their logo and company colors on the apparatus 100 such as with a rewards card.

The anti-slip layer 120 should be selected to be anti-slip or non-slip rather than having adhesive qualities. This enables the apparatus 100 to readily be functional in its intended usage without accumulating debris or transferring adhesives to other materials such as car keys, cell phones, and the like. Such a quality further enables the apparatus 100 to be readily reusable.

Additionally, adhesive surfaces may damage the integrity of the thin plastic bag or other similarly situated material(s). The anti-slip layers 120 should be at least water resistant and may be water proof. This prevents water from interfering with the apparatus functionality 100 and potentially separating the anti-slip layer 120 from the tag body 125.

The anti-slip layer 120 should also be selected for its coefficient of friction with different materials. Preferably, the most important material is plastics, but other materials and the anti-slip layer's 120 interaction with these different materials such as paper, either singularly or in conjunction, can make a difference. Preferably, the coefficient of friction with the intended/targeted material(s) is preferably 0.2 or greater and more preferably about 0.5. In some embodiments, the coefficient of friction is about 1 to about 2.

Generally, the anti-slip layer 120 may be a siloxane(s), resin, rubbers (both natural and synthetic), vinyl, textured metal, elastic polymers, acrylics, epoxies, and the like or any combination thereof. In a preferred embodiment the anti-slip layer 120 is a UV cured resin such as Rez-Cure® UV 1030 manufactured by Innovative Resin Systems of Wayne, N.J. Such an anti-slip layer 120 is compatible with plastic substrates and flexible enough (hardness Shore OO@24 hrs in room temperature=65-85) to be used thereon. Preferably, the anti-slip layer 120 is about ⅛" inches thick and may be about 1/32" inch to about 1 inch thick. Further, as noted above the edges of the anti-slip layer 120 are preferably beveled as shown in FIGS. 2A and 2B.

The apparatus 100 should be sized to be carried on a person without creating undue weight or distraction. The apparatus 100 may be irregularly shaped and should be between about 2.5 cm (1 inch) to about 13 cm (5 inches) in length and preferably about 7.6 cm (3 inches) in length. The apparatus 100 should be about 1.3 cm (0.5 inch) to about 7.6 cm (3 inches) in width and is preferably about 3.8 cm (1.5 inches) in width. The aperture 115 may be sized to accommodate a key chain ring 130 but may be alternatively sized to accommodate a bracelet, necklace, lanyard, string, or the like. It may be preferable to have the edge of the aperture 115 reinforced to prevent wear and tear.

What is claimed is:

1. A material separation device comprising:

a tag body having an upper surface and a lower surface with an aperture extending there through; and a UV cured resin disposed on the upper surface and the lower surface of the device, wherein the UV cured resin either partially covers or fully covers the respective surface, wherein the UV cured resin forms a beveled edge where it meets the edge of the tag body, and wherein the UV cured resin has a coefficient of friction with plastic of about 1 to 2.

2. The device of claim 1 wherein the tag body comprises a metal, plastic, resin, composite, glass, stone, paper, or any combination thereof.

3. The device of claim 1 wherein at least one surface of the device has brand, logo, slogan, bar code, or any combination thereof disposed thereon.

4. The device of claim 1 wherein the device is reusable.

5. A material separation device comprising:

a tag body having an upper surface and a lower surface with an aperture extending there through, wherein on at least one of the upper surface or the lower surface there is a scannable bar code disposed thereon; and a resin disposed on the upper surface and the lower surface of the device, wherein the resin either partially covers or fully covers the respective surface or surfaces, wherein the resin forms a beveled edge where it meets the edge of the tag body, and wherein the resin has a coefficient of friction with a secondary material of about 1 to 2.

6. The device of claim 5 wherein at least one surface has a logo, slogan, brand, or any combination thereof.

7. The device of claim 5 wherein the device is a supermarket rewards card.

8. The device of claim 5 wherein the resin has a hardness of about 65 to about 85 on the Shore Hardness OO scale.

* * * * *